United States Patent [19]

Garvison

[11] Patent Number: 4,981,128

[45] Date of Patent: Jan. 1, 1991

[54] ARROW RELEASE DEVICE

[76] Inventor: Geary L. Garvison, 13757 64th St., South Haven, Mich. 49090

[21] Appl. No.: 403,276

[22] Filed: Jul. 28, 1989

[51] Int. Cl.[5] ..... F41B 5/00

[52] U.S. Cl. ..... 124/35.2; 124/90; 124/91

[58] Field of Search ..... 124/31, 35 R, 35 A, 124/90, 91

[56] References Cited

U.S. PATENT DOCUMENTS

| | | | |
|---|---|---|---|
| 2,819,707 | 1/1958 | Kayfes et al. | 124/35 A |
| 3,847,133 | 11/1974 | Awiszus | 124/35 A X |
| 4,086,904 | 5/1978 | Suski et al. | 124/35 A X |
| 4,134,369 | 1/1979 | Cook | 124/35 A |
| 4,151,825 | 5/1979 | Cook | 124/35 A |
| 4,509,497 | 4/1985 | Garvison | 124/35 A |
| 4,539,968 | 9/1985 | Garvison | 124/35 A |
| 4,791,908 | 12/1988 | Pellis | 124/35 A |
| 4,930,485 | 6/1990 | Kopper | 124/91 |

OTHER PUBLICATIONS

"How to Tie the Loop", Bow and Arrow Magazine, pp. 46–47, Apr. 1986.

*Primary Examiner*—Randolph A. Reese
*Assistant Examiner*—Jeffrey L. Thompson
*Attorney, Agent, or Firm*—Gordon W. Hueschen

[57] ABSTRACT

A bowstring release device has a female part adapted to be fastened to the wrist of an archer and a male part adapted to be fastened to the bowstring. The male part is adapted to be received by the female part and held therein by a keeper until it is released by actuating a triggered release mechanism. The female part also has bowstring-receiving slots so that it can be used with a bow that does not have a male member attached to the bowstring. The female part has a universal joint interposed between it and the device used to fasten it to the wrist of the archer.

10 Claims, 2 Drawing Sheets

ARROW RELEASE DEVICE

FIELD OF THE INVENTION AND PRIOR ART

The invention relates to an arrow release device for freestanding bows and is particularly directed to such a device in which the arrow is aligned in the centerline of the release device and in which the release device has a separable male member permanently attached to the bowstring.

The term "freestanding bow" is used in contradistinction to crossbows and the like and is intended to refer only to those bows in which the bow is held in one hand and not otherwise supported and the bowstring is drawn by the other hand and is not otherwise held in drawn position at the time of the release. The term "off side" of the bowstring refers to the side away from the bow.

Various arrow release devices are known, such as those disclosed in my U.S. Pat. Nos. 4,509,497 and 4,539,968, and the art cited in them. However, most, if not all of these have release devices that grasp the bowstring along side of the nock. As a result, the arrow is out of alignment with the centerline of the release device. In contrast, U.S. Pat. No. 2,819,707 shows a release device which grasps the bowstring on each side of the arrow. However, none of these patents shows a device in which a separable part thereof is permanently attached to the bowstring. As a result of these novel concepts of the present invention, greater consistency and uniformity in the release of successive arrows is obtained.

SUMMARY OF THE INVENTION

The invention is directed to improvements in an arrow release device for freestanding bows in which the bowstring is drawn and released to shoot an arrow, in which an improvement of said release device comprises a two-part unit, one of which parts is permanently attached to the bowstring.

The invention also comprises one or more further features wherein the two-part unit comprises a male member adapted to be received in a female member and held therein by a triggered release mechanism until it is actuated to release position; anchoring means for fastening said male member to the off side of the bowstring; anchoring means which comprises sheet material wrapped around said bowstring and having spaced-apart string-receiving clamps which leave a portion of the bowstring exposed for the purpose of nocking an arrow thereon; in which the sheet material comprise wraparound portions which form said spaced-apart string-receiving clamps and lapped portions which are disposed on the off side of the bowstring and have opposed axial depressions therein which form an axial passageway, e.g., a tube, adapted to receive said male member; in which the male member has a pin thereon which is adapted to freely rotate in said passageway and an enlarged head adapted to prevent axial movement of said pin; in which the male member comprises a spherical ball affixed to the free end of said pin; in which the female member has a keeper adapted to be rotated from closed position to open position and to be held in closed position by a triggered release mechanism and adapted to engage and to hold said male member in the closed position until said triggered release mechanism is actuated to release position; in which the keeper has a transaxial slot and the male member has engaging means adapted to be engaged by the sides of said slot; in which the engaging means is a spherical ball; in which said ball is affixed to a pin rotatably mounted in means for attaching it to the off side of the bowstring; in which said female member comprises a universal joint; and in which said universal joint is interposed between said female member and means for fastening it to the wrist of the archer.

The invention also relates to a release device for drawing and releasing an arrow from a freestanding bow which comprises draw and release means whereby said arrow can be drawn and released by the archer, and universal joint means interposed between said draw and release means and the archer, and especially to such a release device in which said draw and release means comprises a laterally-projecting trigger which is easily accessible to the trigger finger of the archer, and in which said universal joint is oriented to prevent movement of the trigger to a position not easily grasped by the trigger finger of the archer, and particularly to such a release device in which said universal joint is a two-way flexing, non-swiveling type.

DESCRIPTION OF A PREFERRED EMBODIMENT

Figure 1:
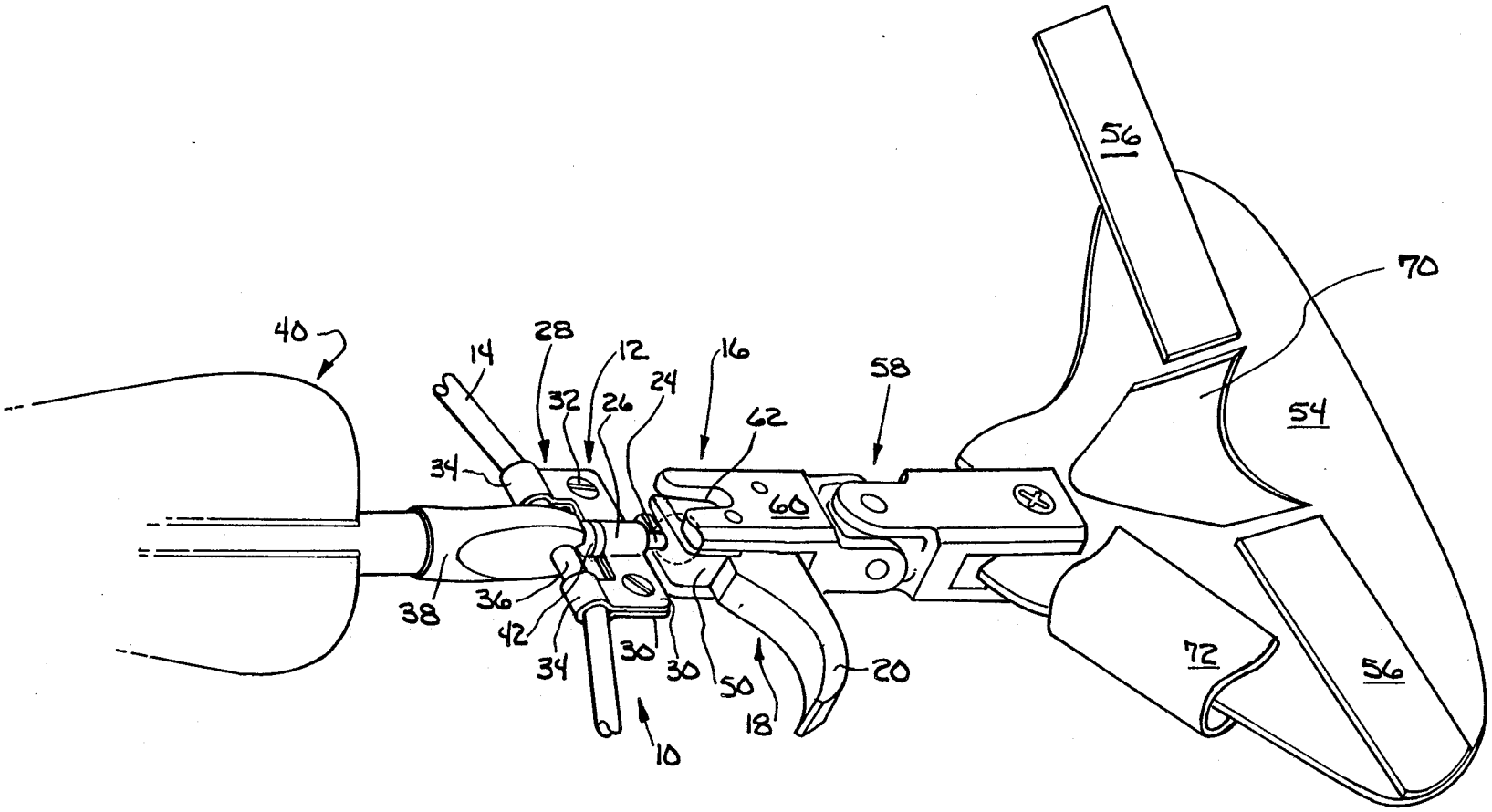
FIG. 1 is an isometric view of a release device of the invention showing complementary male and female portions held together as a unit by a triggered release mechanism.

The invention relates to an arrow release device 10 for a freestanding bow in which the release device 10 has a male portion 12 permanently attached to the bowstring 14. The male portion 12 is adapted to be received into a female portion 16 and adapted to be held therein by a triggered release mechanism 18 until such time as the triggered release mechanism 18 is actuated by a pull on its trigger 20.

The male member 12 comprises a ball 22 fastened to the end of an axially disposed spindle or pin 24 freely rotatable in sleeve 26 which is axially disposed in clamp 28 and formed from opposed semicylindrical depressions in the juxtaposed faces 30. The clamp 28 is formed of a flat sheet of brass or like material folded upon itself to provide juxtaposed faces 30 which are fastened together by suitable fasteners 32. The sheet has a central cutout portion such that, when it is folded on itself, it provides bowstring-grasping portions 34 exposing a portion 36 of bowstring 14 adapted to be grasped by nock 38 of the arrow 40. The bowstring-grasping portions 34 are preformed into the sheet so that, when the sheet is folded on itself, the bowstring-receiving portions 34 will be generally circular in cross section and of a size to clamp the bowstring therein when the folded sheet is folded on itself and fastened together by fasteners 32. The pin or spindle 24 is held against axial movement by a head 42 which is swaged or otherwise formed thereon.

Figure 3:
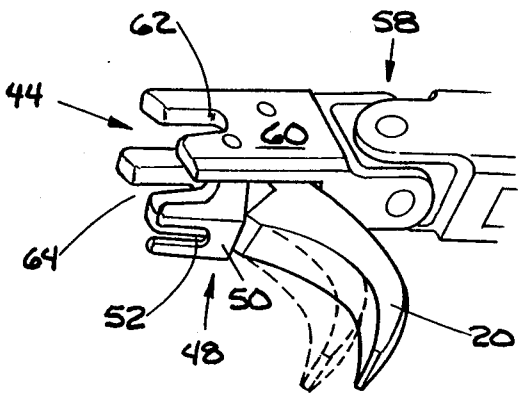
FIGS. 2 and 3 are isometric partial views showing the position of male and female portions following actuation of the triggered release mechanism.
Figure 2:
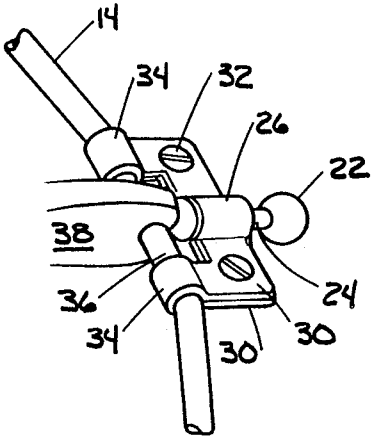

The female portion 16 has a hollow end portion 44 in which is pivoted an L-shaped keeper 48 which is held in the closed or retaining position shown in FIG. 1 when the trigger 20 is in the position shown in that figure and freed to assume the release position shown in FIG. 3 when the trigger is pulled to the release position shown there. The keeper 48 has in its transverse face a transaxial slot 52 wide enough freely to receive pin 24 but not wide enough to pass the ball 22. Thus, in the closed or retaining position shown in FIG. 1, the male and female portions are held together as a unit and the arrow can be drawn to the release position. For this purpose the female portion is fastened to a wrist wraparound 54 having a thumbhole 70 and a finger-grasping portion 72. The wrist wraparound 54 is essentially the same as shown in my prior patents except that the straps have been replaced by Velcro fasteners 56.

Between the wraparound 54 and the female portion 16 of the release device 10, there is disposed a universal joint 58 which allows the female member 16 enough freedom of movement to prevent canting of the release device during the draw. This assures that the arrow and the release device will always be aligned in the line of flight.

In FIG. 3, the top and bottom faces 60 may have, if desired, longitudinally disposed slots 62 and 64. With this construction, the portion shown in FIG. 3 can be used just like the release devices of my prior patents, that is, with a bowstring that has no male member attached thereto. This has the advantage over my prior patents of having the universal joint so that no unintentional bind or cant is placed on the draw. In the case where a trigger having axial symmetry is used, it may be desirable to provide a swivel action whereby the wraparound 54 can be turned relative to the bowstring, but this is otherwise undesirable because it allows a laterally-projecting trigger to rotate to a position in which it is not readily accessible to the trigger finger of the archer. In the device of FIG. 1, no such swivel is needed because the pin 24 provides a swivel which is not between the wraparound and the trigger. Also, the ball 22 is free to swivel in the keeper 48. Desirably the universal joint is a standard two-way flexing, non-swiveling, type of universal joint, such as those commonly used in drive shafts, so that a laterally-projecting trigger does not rotate out of the general plane of the wraparound. Thus, by twisting the wrist, the trigger follows the twist, which would not be the case were a swivel used in place of or in conjunction with the universal joint.

While the invention has been described with reference to particular embodiments thereof, it is to be understood that it is not to be limited in the details of these embodiments as variations will readily be apparent to those skilled in the art once they have been apprised of the invention and that the invention, accordingly, is not to be limited except by the scope of the appended claims.

I claim:

1. An arrow release device which comprises a two-part unit which comprises a triggered release mechanism and a non-flexible male member permanently attached to a bow string, said male member having an enlarged head which has axial symmetry and is adapted to be rotatably received in a female member and held therein by said triggered release mechanism until it is actuated to release position.

2. An arrow release device of claim 1 which further comprises anchoring means for fastening said male member to the off side of the bowstring.

3. In an arrow release device for freestanding bows in which the bowstring is drawn and released to shoot an arrow, the improvement in which said release device comprises a two-part unit, one of which parts is permanently attached to the bowstring; in which said two-part unit comprises a male member adapted to be received in a female member and held therein by a triggered release mechanism until actuated to release position; which further comprises anchoring means for fastening said male member to the off side of the bowstring; and in which said anchoring means comprises a single sheet of sheet material wrapped around said bowstring and having spaced-apart string-receiving clamps which leave a portion of the bowstring exposed for the purpose of nocking an arrow thereon.

4. An arrow release device of claim 3 in which said sheet material comprises wraparound portions which form said spaced-apart string-receiving clamps and lapped portions which are disposed on the off side of said bowstring and have opposed axial depressions therein which form an axial passageway adapted to receive said male member.

5. In an arrow release device for freestanding bows in which the bowstring is drawn and released to shoot an arrow, the improvement in which said release device comprises a two-part unit, one of which parts is permanently attached to the bowstring; in which said two-part unit comprises a male member adapted to be received in a female member and held therein by a triggered release mechanism until it is actuated to release position; which further comprises anchoring means for fastening said male member to the off side of the bow string; in which said anchoring means comprises sheet material wrapped around said bowstring and having spaced-apart string-receiving clamps which leave a portion of the bowstring exposed for the purpose of nocking an arrow thereon; in which said sheet material comprises wraparound portions which form spaced-apart string-receiving clamps and lapped portions which are disposed on the off side of said bowstring and have opposed axial depressions therein which form an axial passageway adapted to receive said male member; and in which said male member has a pin thereon which is adapted to freely rotate in said passageway and which is provided with an enlarged head adapted to prevent axial movement of said pin.

6. An arrow release device of claim 5 in which said male member comprises a spherical ball affixed to the free end of said pin.

7. In an arrow release device for freestanding bows in which the bowstring is drawn and released to shoot an arrow, the improvement in which said release device comprises a triggered release mechanism and a non-flexible male member permanently attached to a bow string, said male member having an enlarged head which has axial symmetry and is adapted to be rotatably received in a female member and held therein by said triggered release mechanism until it is actuated to release position and in which said female member has a rotatable keeper adapted to be rotated from closed position to release position and to be held in closed position by said triggered release mechanism and adapted to engage said head and to hold said male member in the closed position until said triggered release mechanism is actuated to its release position.

8. In an arrow release device for freestanding bows in which the bowstring is drawn and released to shoot an arrow, the improvement in which said release device comprises a two-part unit, one of which parts is permanently attached to the bowstring; in which said two-part unit comprises a male member adapted to be received by a female member and held therein by a triggered release mechanism until actuated to release position; in which said female member has a keeper adapted to be rotated from closed position to release position and to be held in closed position by a triggered release mechanism and adapted to hold said male member in the closed position until said triggered release mechanism is actuated to its release position, and in which said keeper has a transaxial slot and said male member has engaging means adapted to be engaged by the sides of said slot.

9. An arrow release device of claim 8 in which said engaging means is a spherical ball.

10. An arrow release device of claim 9 in which said ball is affixed to a pin rotatably mounted in means for attaching it to the off side of the bowstring.

* * * * *